162-252 SF
10/15/85 CF 4,547,266

United States Patent [19]

Keller et al.

[11] Patent Number: 4,547,266

[45] Date of Patent: Oct. 15, 1985

[54] APPARATUS FOR PROVIDING SELECTIVELY DIFFERENTIATED VACUUM ACROSS A PAPERMAKING MACHINE WIDTH

[75] Inventors: Martin B. Keller; Roger A. Ahrens, both of Hudson Falls, N.Y.

[73] Assignee: Sandy Hill Corporation, Hudson Falls, N.Y.

[21] Appl. No.: 518,465

[22] Filed: Jul. 29, 1983

[51] Int. Cl.[4] ..... D21C 1/48

[52] U.S. Cl. ..... 162/252; 162/279; 162/352; 162/366; 162/374

[58] Field of Search ..... 162/252, 253, 199, 374, 162/297, 351, 279, 364, 366, 352, 274

[56] References Cited

U.S. PATENT DOCUMENTS

| | | | |
|---|---|---|---|
| 3,149,026 | 9/1964 | Hornbostel, Jr. | 162/297 |
| 3,859,163 | 1/1975 | Haythornthwaite | 162/252 |
| 3,935,061 | 1/1976 | Biornstad | 162/252 |
| 4,308,077 | 12/1981 | Bolton | 162/252 |

*Primary Examiner*—Steve Alvo

*Attorney, Agent, or Firm*—Ross, Ross & Flavin

[57] ABSTRACT

Mechanism for automatically controlling and maintaining a selectively differentiated vacuum pressure in a vacuum head accommodating to the transverse width of a moving web passing relative thereto involving means for supplying air to the vacuum head at spaced points along the width and control means for detecting the need for an increase or decrease in the vacuum at the spaced points along the length and selectively charging more or less air to the vacuum head at the corresponding points along the length.

1 Claim, 2 Drawing Figures

APPARATUS FOR PROVIDING SELECTIVELY DIFFERENTIATED VACUUM ACROSS A PAPERMAKING MACHINE WIDTH

GENERAL

The present invention relates to new and useful improvements and structural refinements in papermaking machinery having general utility in the arts, and more particularly aims to provide an improvement in the means for providing a variation of vacuum across a machine width.

That is, the invention comprehends a suction regulating means and more particularly an arrangement for maintaining stable and uniform conditions in a suction chamber in a device such as a papermaking machine.

In many industrial dewatering systems involving such as papermaker's felts, dewatering periodically during use is required. For this purpose, a variety of different types of suction dewatering systems have been developed including those which employ suction boxes or suction pipes. The pipes or boxes include a slot structure with an upper wear surface over which the medium passes into alignment with a slot subjected to a source of suction. Water is drawn by the suction force from the felt as it passes over the slot and is collected in the box or pipe and then is disposed of in a known manner.

Felts or similar materials age and undergo physical changes such that certain parameters, i.e. permeability, change. A decrease in permeability, for instance, will lead to a greater resistance to dewatering, and the degree of resistance may vary across the machine width, dictating in time modifications in the dewatering procedure. One way of meeting the dictate is to increase the slot width so as to provide for a greater exposure of the felt to the suction force as it passes over the slot. Another way of meeting the dictate, especially here there are variances in permeability across the felt width is to vary the degree of suction in the slot or throat across the machine width.

The changing of the slot width poses various manual or mechanical procedures usually necessitating an interruption in the dewatering process.

Therefore, further improvements in suction dewatering systems have been indicated as desirable without requiring the felt to be periodically checked to determine if it is operating efficiently and without the need of shutting down the machine to manually adjust slot sizes by changing slot cover configurations.

SUMMARY OF THE INVENTION

With the above background in mind, it is among the primary objectives of the present invention to provide a suction dewatering device with a suction pipe which is automatically adjustable in terms of the suction in the suction slot for dewatering of a medium such as a papermaker's felt or wire. That is, the invention allows the provision of selectively differentiated suction across the face of a web being formed so as to attain uniformity thereacross.

A control system senses the vacuum level at various points along the transverse width of the throat of the suction device and as it increases or decreases, as it normally will over the life of the machine and during the life of any particular medium being formed, the control system will operate to vary the degree of vacuum at any position or positions across the device.

The control thereby maintains optimum efficiency in the system and continuously monitors the operation.

Additionally, vacuum pump requirements are minimized since dewatering efficiency is maintained at the highest possible level throughout the felt life. Thus, cost, and other equipment savings are achieved.

In summary, a suction dewatering system is provided including a suction device adapted to be connected to a suction source and having a longitudinal opening therein through which suction is applied. A cover is provided and includes at least two spaced lands with means thereon for mounting the lands to the suction device and the space therebetween forming a slot in alignment with the longitudinal opening in the suction device. A wear strip is removably mounted on each land and has a wear surface for a media to be passed thereover for dewatering. One of the wear strips may have adjustment means thereon so that shifting of each adjustable strip in the longitudinal direction will cause the strip to shift laterally and vary the slot width in the direction of travel of the medium across the wear surface and varying the dwell time of the medium over the slot to which suction is being applied. And means are provided for selectively increasing or decreasing the degree of vacuum at any particular zone in the throat responsively to automatically or manually operated control means.

The above elucidated concept has been embodied into a practical application for a situation where a saturant being supplied to the sheet being formed is supplied unevenly, which is to say, with variable amounts being supplied at different points horizontally across the web width. In such instances, an increased vacuum is necessary where higher amounts have been deposited and a decreased vacuum is desirable where lesser amounts have been deposited for the desideratum of achieving a sheet with a uniform amount of saturant across the entire width of the formed sheet.

THE PRIOR ART

It will be helpful to an understanding hereof to consider briefly some of the more essential and important features and aspects of the prior art in its light, so that same may be kept in mind during the subsequent reading of the detailed description of the practical embodiment of our improvements and illustration thereof in the hereunto annexed drawing.

The existing practice in the trade, as exemplified by the constructions heretofore known, has been to employ the same constant degree of vacuum horizontally across the machine width at any particular point along the machine length and to vary the degree of vacuum, if at all, only at points lengthwise of the web as it is being formed. That is, the pressure in any particular vacuum head extending transversely of the web is substantially constant and where a differential exists, it may exist only at spaced areas along the web length as it passes through the machine.

That is, the degree of suction at one point along the web length as it travels over the machine may be greater or lesser than the degree of suction at a point forwardly or rearwardly thereof along the web length.

The known prior constructions are thus attended with certain serious limitations. The paucity of suitable instrumentation has been the stimulus for the improvisations herein disclosed.

The invention relates to vacuum control mechanisms and, although they are particularly adapted for use in connection with papermaking machines, they are adapted for use elsewhere wherever it is desired to maintain variable vacuum pressures at different locations on a moving web of material.

If the basis weight of a sheet has varied across the machine, it is apparent that it has presented a variable flow resistance during its formation. Obviously, a higher vacuum should have been applied where the basis weight is higher; conversely a lower vacuum should have been applied where the basis weight is lower (i.e. in the lighter areas), all so as to attain the desideratum of a uniform degree of dewatering across the web width during formation.

More specifically it is an object of the invention to provide novel means for automatically controlling the pressure in the suction heads of a paper making machine, such as the flat boxes, couch rolls, felt suction boxes, or other mechanism relative to which the web moves and incorporating a suction means therewith which extends transversely of the web.

An air header supplying pressurized air is extendable across the machine width is connected with and supplies pressurized air to a plurality of branches strategically spaced from each other at suitable intervals, say anywhere from 2" to 10", according to the dictates of the medium being formed, each said branch being equipped with a control valve of either the automatic or mechanical type, directly or remotely operated.

The control valve allows a variable amount of air to enter a selected area of the throat of the vacuum box beneath the wear strips supporting the medium supporting felt or wire. An increase in air flow into the vacuum slot at any particular point or area causes a decrease in the vacuum thereat. Conversely a decrease in air flow into the vacuum slot at that same point or area causes an increase in the vacuum thereat.

The invention is capable of receiving a variety of mechanical expressions, one of whch is shown on the accompanying drawings, but it is to be expressly understood that the drawings are for the purpose of illustration only and are not to be construed as a definition of the limits of the invention, reference being had to the appended claims for that purpose.

BRIEF DESCRIPTION OF THE DRAWING

To enable others skilled in the art so fully to comprehend the underlying features hereof that they may embody the same in the various ways contemplated by this invention, drawings depicting a preferred typical construction is herein the invention is embodied in concrete form have been annexed as parts of this disclosure, and in such drawings.

DETAILED DESCRIPTION

Figure 1:
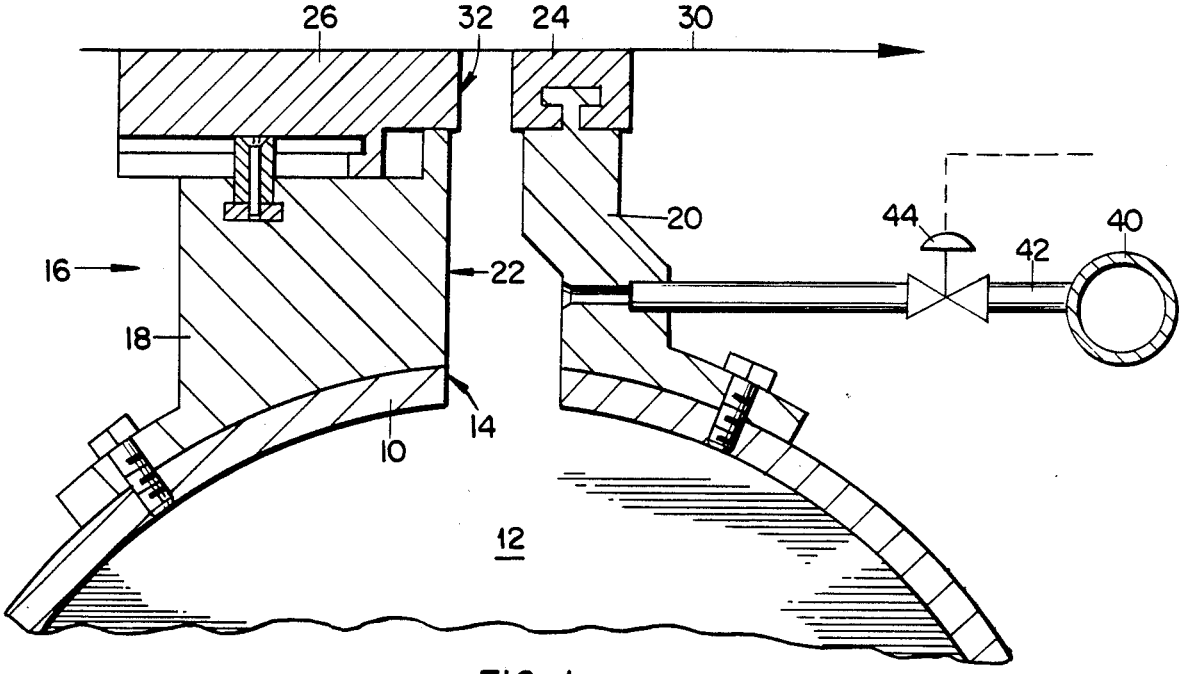
FIG. 1 is a fragmentary simplified sectional view in side elevation showing the elements of the invention.
Figure 2:
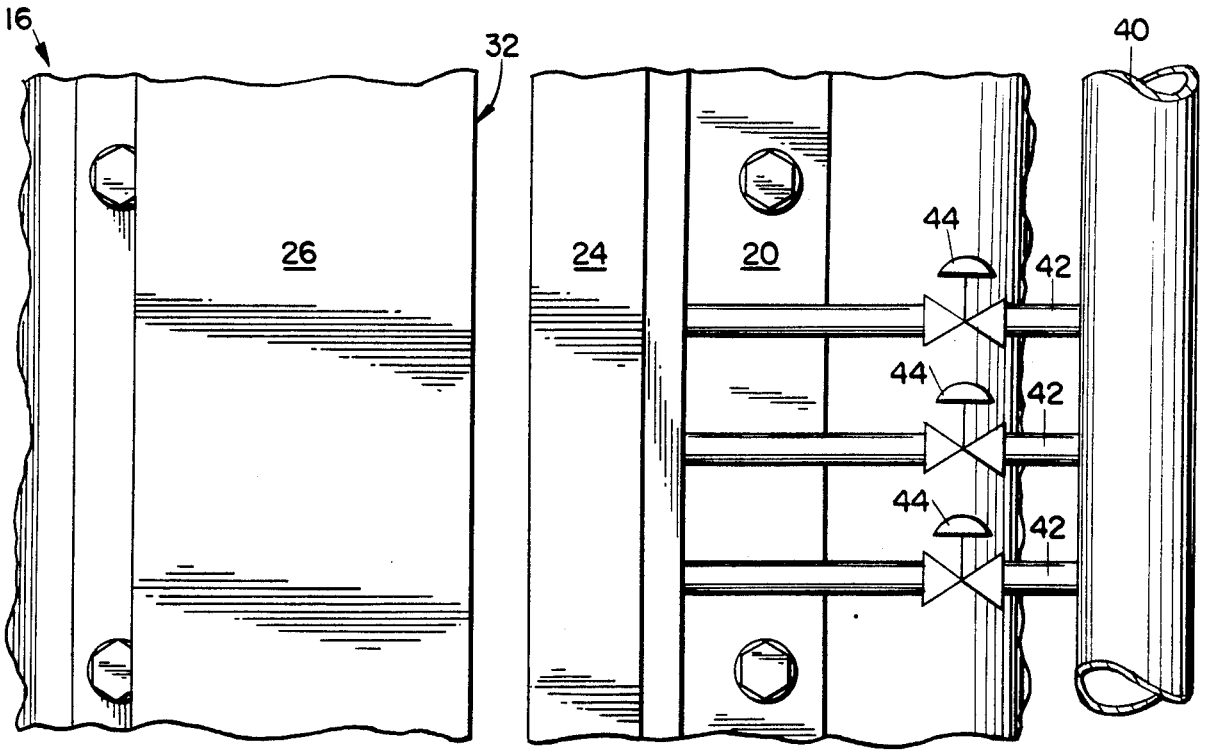
FIG. 2 is a fragmentary simplified view in top plan showing the elements of the invention.

The precise construction of the figures of the drawing need not be slavishly followed as, of course, the mechanism may have to be mechanically varied or alternatively constructed or modified in accordance with any specific use contemplated therefor. Such adaptations and/or alternative constructions and/or modifications are intended to be comprehended within the meaning and purview and range of equivalence of the below subjoined claims, there being no intent to have this invention limited to or circumscribed by any specific details. For instance, and as aforementioned, according to the sophistication desired, the air bleed valves can be either hand operated with remote controls or can be integrated so as to be automatically operative.

The area of improvement of the present invention resides in the structure of the dewatering system and the components are shown more or less diagrammatically and adapted for association with a papermaking machine of standard construction.

The cover structure is mounted to a well known type of suction pipe 10 having a hollow interior 12 connected at one end to a source of suction in a conventional manner (not shown).

Suction pipe 10 has a longitudinal slot 14 in its upper surface portion communicating with hollow interior 12 and accordingly subjected to the same source of suction.

A cover 16 is mounted to suction pipe 10 so that it is in predetermined alignment with respect to longitudinal slot 14.

In the depicted embodiment, cover 16 includes a pair of spaced lands 18, 20 which extend along the length of suction pipe 10 at least as long as the length of longitudinal slot 14.

Lands 18, 20 are spaced from one another to provide a longitudinal opening or throat 22 therebetween in alignment with slot 14 and in communication therewith.

Land 20 is mounted to suction pipe 10 in fixed position in a conventional manner such as by use of bolting (not shown).

In a similar manner, land 18 is mounted in fixed position on suction pipe 10.

An elongated stationary wear strip 24 is removably mounted on land 20 and an elongated adjustable wear strip 26 is removably mounted on land 18.

The upper surfaces of the wear strips form wear surfaces for a medium such as a wire or felt 30 to be passed thereacross for dewatering purposes.

The wear strips are spaced from one another to provide an aperture 32 therebetween in alignment with throat 22 to provide a continuous longitudinal slot for communication between pipe interior 12, and the upper surface of the device so that suction applied therethrough will dewater the medium passing across the wear surfaces and over the opening therebetween.

In use, a medium such as a papermaker's felt 30 is arranged to pass laterally over the suction dewatering system in the direction of the arrow of FIG. 1. When the medium is new it has a greater permeability and is less resistant to air flow. With this in mind, in the present system, it is desirable to have the opening as small as possible.

During use, the felt develops reduced permeability thus increasing resistance to air flow. Accordingly, the vacuum in pipe 10 increases. This increase in vacuum can be monitored and sensed in a conventional manner by a conventional type of sensor (not shown) and a conventional type of actuator (also not shown). This control for signalling a need for adjusting the width of the opening between the wear strips is known, as aforesaid, and does not form a part of this invention.

An air header 40 extends transversely across the machine and is connected with the usual supply means (not shown) for leading pressurized air therethrough.

At spaced points therealong, branches 42 are provided and are in direct communication with vacuum slot 22.

Each branch 42 is suitably valved as by a valve 44.

A conventional control system can sense the vacuum level in the suction devices and as it increases or decreases in any particular zone, will signal operation of the valving so as to admit more or less air to the throat thereat.

By the use of the provided controls, it is possible to attain fine tuning of the vacuum by the control of the pressurized air bled into the vacuum throat.

It will be apparent, however, that the specific physical embodiment delineated, albeit the preferred exemplification, is only exemplary and explanatory of but one of the multiplicity of ways in and purposes for which the principles of the invention may be employed. The invention reverted to is not restricted or confined to said embodiment and is not intended to be exhaustive of, nor limiting of, the spirit or scope hereof. Rather it is submitted as a best known structural embodiment for the purpose of illustrating the invention and explaining the details of construction and arrangement of parts, in accordance with the patent statutes, that others skilled in the art to which the invention pertains may so fully understand the invention, its principles and applications thereof, that they may embody same and adapt them in numerous forms, each as may be best suited to the conditions and requirements of any particular use.

The embodiments of the invention in which an exclusive property or privilege is claimed are defined as follows:

1. In a Fourdrinier papermaking machine, the combination of:

a travelling Fourdrinier forming wire, means fo depositing a layer of paper stock in a web-forming condition on the top wire surface, a vacuum source, a vacuum pipe having an interior connected to the vacuum source and extending laterally across and beneath the wire, a longitudinal through slot along the upper surface of the vacuum pipe, a cover mounted on the upper surface of the vacuum pipe including a pair of spaced lands extendable along the length of the vacuum pipe for defining an upwardly facing throat therebetween in alignment and communication with the vacuum pipe through slot, a pair of spaced wear strips each mounted on the top of a respective land of the pair thereof for supporting the wire traversible therepast with the space between the strips defining a slot in alignment and communication with the upwardly-facing throat, a pressurized air header extending transversely across and beneath the wire and in spaced parallelism with the vacuum pipe, a plurality of air conduits spaced along and leading from the air header, each air conduit extending into one of the lands and being in open communication with the throat in a respective area along the length thereof and each air conduit containing a valve means for selectively controlling the valves to selectively bleed air into the vacuum in the throat at said respective area along the length thereof.

* * * * *